US007562701B2

(12) United States Patent
Lacusta et al.

(10) Patent No.: US 7,562,701 B2
(45) Date of Patent: Jul. 21, 2009

(54) ECCENTRIC WELLHEAD HYDRAULIC DRIVE UNIT

(75) Inventors: Gregg Lacusta, Lloydminster (CA); Daniel Graf, Lloydminster (CA)

(73) Assignee: Innovative Production Technologies Ltd., Calgary, Alberta (CA)

( * ) Notice: Subject to any disclaimer, the term of this patent is extended or adjusted under 35 U.S.C. 154(b) by 384 days.

(21) Appl. No.: 11/175,303

(22) Filed: Jul. 7, 2005

(65) Prior Publication Data

US 2006/0222525 A1 Oct. 5, 2006

(30) Foreign Application Priority Data

Dec. 22, 2004 (CA) ..... 2490846

(51) Int. Cl.
*E21B 43/00* (2006.01)

(52) U.S. Cl. ..... 166/68.5; 166/72

(58) Field of Classification Search ..... 166/68.5, 166/72, 77.4, 383; 92/181 P, 181 R; 417/398
See application file for complete search history.

(56) References Cited

U.S. PATENT DOCUMENTS 3,334,690 A * 8/1967 Garrett ..... 417/109
4,745,969 A * 5/1988 Henderson ..... 166/68.5
4,991,650 A * 2/1991 McLeod ..... 166/72
5,803,178 A * 9/1998 Cain ..... 166/306
6,854,515 B2 * 2/2005 Matthews et al. ..... 166/68.5
2002/0074116 A1 * 6/2002 Millar et al. ..... 166/120
2004/0112586 A1 * 6/2004 Matthews et al. ..... 166/68.5

* cited by examiner

*Primary Examiner*—David J Bagnell
*Assistant Examiner*—Sean D Andrish
(74) *Attorney, Agent, or Firm*—Gowling Latieur Henderson LLP; D. Doak Horne

(57) ABSTRACT

A wellhead hydraulic drive unit to operate various styles of downhole pumps, including a hydraulic cylinder having a piston positioned therein for reciprocation within the cylinder; hydraulic fluid supply conduits contained within the hydraulic cylinder and fluidly communicative with the piston such that hydraulic fluid flowing through the hydraulic fluid supply conduits produces reciprocation of the piston within the hydraulic cylinder, a ram within the cylinder and operably connected to the piston, the ram having a bore; and production tubing inserted through the bore of the ram for enabling well fluid to be discharged from the well, wherein the hydraulic fluid supply conduits are radially offset from a longitudinal axis of the cylinder and the ram is oppositely radially offset from the longitudinal axis of the cylinder. Offsetting the hydraulic fluid supply conduits and the ram allows for a larger inside diameter in both the production tubing and ram, increases the sizes of downhole pumps which can be installed/removed without removal of the drive unit, and serves as an anti-rotational feature with regards to the piston and ram.

19 Claims, 3 Drawing Sheets

PRIOR ART

ECCENTRIC WELLHEAD HYDRAULIC DRIVE UNIT

FIELD OF THE INVENTION

The present invention relates to a drive mechanism associated with artificial lift systems used in the production of oil and other fluids contained within underground formations, and more particularly to a wellhead hydraulic drive unit.

BACKGROUND OF THE INVENTION

Fluid production wells having insufficient pressure are unable to flow liquids to the surface by natural means. Such wells require some form of energy or lift to transfer fluids to the surface.

Several artificial lift systems exist to extract the liquids from liquid-bearing reservoirs. In the case of lifting oil from wells, conventional lifting units include the beam pump and the surface hydraulic piston drive. Both of these lift units are situated at the surface of the well and lift fluid to the surface by "stroking" production tubing or rods inside production casing and/or well casing. The production tubing or rods is/are connected to a wellbore pump configuration, comprising a chamber and a check valve, which allows fluid to enter on the down-stroke and to be lifted to the surface on the up-stroke. These conventional lift units are supplied power from combustion engines or electric drives.

Beam pumps and surface hydraulic piston drives come in many sizes and are used extensively worldwide. U.S. Pat. Nos. 3,376,826; 3,051,237 and 4,296,678 are all examples of the use of a beam drive for a sucker string actuated pump. U.S. Pat. No. 4,403,919 is an example of a surface powered hydraulic pumping unit.

There are many drawbacks associated with the use of conventional beam pumps and surface hydraulic piston drives. These units are large, obtrusive and considered unsightly in many sensitive regions. Further, the tubing and/or rods from within the wellbore must extend outside the well through a stuffing box to connect the drive units to same. The stuffing box prevents the wellbore fluids from escaping to the surrounding surface environment, however, rarely is this completely successful, thereby resulting in hydrocarbon contamination of the ground surrounding the wellhead.

There are additional drawbacks to the use of conventional beam pumps and surface hydraulic piston drives. These units present a hazard to workers in the surrounding area as a result of exposure to surface moving parts. Further, beam pumps often experience alignment problems resulting in stress on the rods, undue wear and eventual failure. Finally, there are numerous dangers to personnel associated with assembly, transportation, installation, operation and maintenance due to the size of the units and their many moving parts.

U.S. Pat. No. 4,745,969 provides for a hydraulic/mechanical system for pumping oil wells that has a surface unit that can be hung inside of the well casing, so that there are no mechanical working parts outside of the well casing except for surface pipeline connections. However, this in-casing hydraulic jack system must be suspended from 20 to 40 feet below the surface of the ground, depending upon the required stroke. Further, the hydraulic jack unit is sealed within the well casing, resulting in a casing interior space for collecting reservoir fluid above the sealing means; this could result in leakage from the casing interior space to the environment, especially when lifting the hydraulic jack from the casing.

To address such issues, recently-allowed U.S. patent application Ser. No. 10/331,491 (Publication No. 2004/0112586), having one inventor in common with the present invention, teaches a wellhead hydraulic drive unit to operate various styles of downhole pumps, which is installed as an integral part of a wellhead thereby eliminating the need for a stuffing box. The wellhead hydraulic drive unit taught therein comprises a hollow hydraulic cylinder having a piston positioned therein, a hydraulic fluid supply means attached to the hydraulic cylinder for producing reciprocation of the piston within the hydraulic cylinder, a hollow ram means slideably received within the inner wall of the hydraulic cylinder and connected to the piston for reciprocation in response to the piston, and a production tube means inserted through the ram means for enabling well fluid to be discharged from the well.

While this unit did address many needs in the field of artificial lift systems, the present inventors perceived a need for increased adaptability and versatility, particularly noting the need to be able to install and remove an entire downhole pump assembly into a well without having to remove the installed wellhead hydraulic drive unit.

SUMMARY OF THE INVENTION

According to a first aspect of the present invention, therefore, there is provided a wellhead hydraulic drive unit for operable connection to a downhole production pump via pump connecting means, the wellhead hydraulic drive unit comprising: a hydraulic cylinder having an inner wall and a piston positioned within the inner wall for reciprocation within the hydraulic cylinder; hydraulic fluid supply means contained within the hydraulic cylinder and fluidly communicative with the piston such that hydraulic fluid flowing through the hydraulic fluid supply means produces reciprocation of the piston within the hydraulic cylinder; ram means having a bore therethrough, slideably received within the inner wall of the hydraulic cylinder and operably connected to the piston for reciprocation in response to reciprocative movement of the piston; and production tube means inserted through the bore of the ram means and connected to the hydraulic cylinder for enabling well fluid to be discharged from the well; wherein the hydraulic fluid supply means are radially offset from a longitudinal axis of the hydraulic cylinder and the ram means are oppositely radially offset from the longitudinal axis of the hydraulic cylinder.

According to a second aspect of the present invention there is provided an annular piston for use with a wellhead hydraulic drive unit, the wellhead hydraulic drive unit for operable connection to a downhole production pump via pump connecting means, the annular piston comprising: an outer wall for positioning within an inner wall of an hydraulic cylinder; a bore therethrough for receiving a ram means; passages extending axially through the piston; and hydraulic fluid supply tubing contained within the passages and fluidly communicative with the piston such that hydraulic fluid flowing therethrough produces reciprocation of the piston within the hydraulic cylinder; wherein the hydraulic fluid supply tubing is radially offset from a longitudinal axis of the piston toward the outer wall and the ram means are oppositely radially offset from the longitudinal axis of the piston toward the outer wall.

In preferred embodiments of the present invention, the piston comprises at least one passage extending axially therethrough, the hydraulic fluid supply means comprise at least one hydraulic tube extending through the at least one passage (the at least one hydraulic tube being adapted to selectively pressurize an annular area upstream of the piston so as to cause the piston and ram means to move in a downstream direction, and most preferably comprising a plurality of hydraulic tubes each extending through one of a plurality of passages in the piston), and the hydraulic fluid supply means further comprising at least one hydraulic passage means adapted to selectively pressurize an annular area downstream of the piston so as to cause the piston and ram means to move in an upstream direction (the at least one hydraulic passage means most preferably comprising at least one hydraulic tube at least partially within a gland downstream of the piston). The hydraulic fluid supply means preferably further comprise a gland to which the at least one hydraulic tube is attached.

The plurality of hydraulic tubes are preferably grouped together and radially offset toward one side of the hydraulic cylinder, with the ram means radially offset toward an opposite side of the hydraulic cylinder. The plurality of hydraulic tubes are most preferably generally parallel and spaced along the inner wall of the hydraulic cylinder at a generally equal distance from a central axis of the hydraulic cylinder.

Further, the production tube means are preferably configured to receive the downhole production pump therethrough during installation of the downhole production pump, such that the wellhead hydraulic drive unit need not be removed to allow for installation or removal of the downhole pump mechanism.

In addition, preferred embodiments of the present invention further comprise means for mounting the wellhead hydraulic drive unit to a wellhead, and most preferably the means for mounting the wellhead hydraulic drive unit to the wellhead comprise a hanger means attached to the hydraulic cylinder for landing the hydraulic cylinder within the wellhead. The production tube means are preferably threaded along at least a portion of their length with the gland of the hydraulic fluid supply means threadably receiving the production tube means, a top end of the ram means is preferably threaded with the piston threadably receiving the top end of the ram means, and a bottom end of the ram means is preferably threaded with the pump connecting means threadably receiving the bottom end of the ram means. The pump connecting means are preferably selected from the group consisting of tubing joints, continuous tubing, sucker rods and continuous rods.

Offsetting the hydraulic fluid supply means and the ram in this eccentric wellhead hydraulic drive unit allows for a larger inside diameter in both the production tubing and ram, increases the sizes of downhole pumps which can be installed/removed without removal of the drive unit, and serves as an anti-rotational feature with regards to the piston and ram. Also, significant cost savings can be realized, as pump installations and pump changes can be performed using a conventional flush-by unit, thereby avoiding the higher cost and reduced efficiency of a service rig.

A detailed description of an exemplary embodiment of the present invention is given in the following. It is to be understood, however, that the invention is not to be construed as limited to this embodiment.

BRIEF DESCRIPTION OF THE DRAWINGS

In the accompanying drawings, which illustrate an exemplary embodiment of the present invention.

DETAILED DESCRIPTION OF AN EXEMPLARY EMBODIMENT

Referring now in detail to the accompanying drawings, there is illustrated an exemplary embodiment of an eccentric wellhead hydraulic drive unit according to the present invention, generally referred to by the numeral 100.

Figure 1:
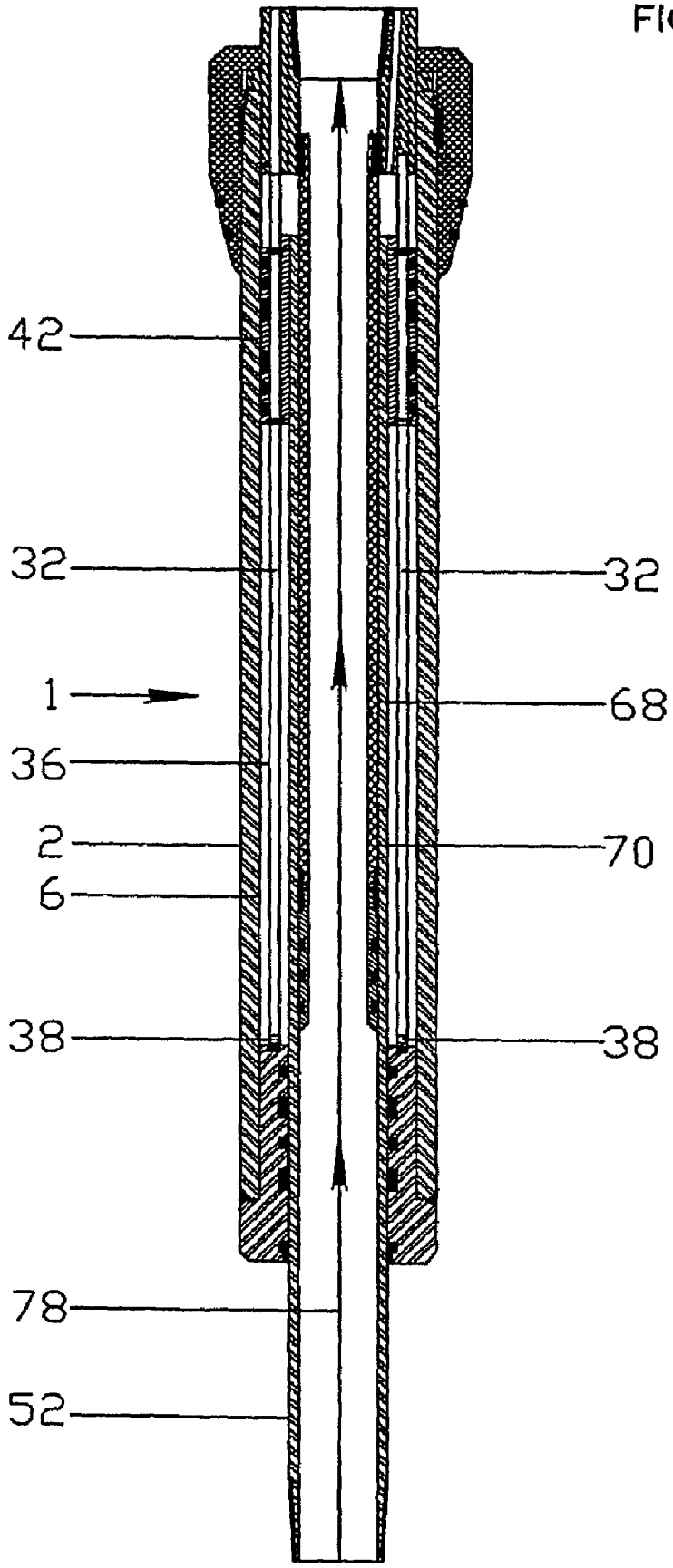
FIG. 1 is a cross-sectional elevation view of a wellhead hydraulic drive unit according to the prior art, namely U.S. patent application Ser. No. 10/331,491 (Publication No. 2004/0112586)

A prior art drive unit is illustrated in FIG. 1, which shows an in-casing wellhead hydraulic drive unit 1 for operable connection to a downhole production pump (not shown) via pump connecting means (not shown), comprising: (a) an hydraulic cylinder 2 configured for placement within and in landed engagement with an uppermost portion of a wellhead casing (now shown), having an inner wall 6 and a piston 42 positioned within said inner wall 6 for reciprocation within the hydraulic cylinder 2; (b) hydraulic fluid supply means 32, 38 coupled to the hydraulic cylinder 2 for raising of the piston 42 within the hydraulic cylinder 2; (c) ram means 52 having a bore therethrough, slideably received within the inner wall 6 of the hydraulic cylinder 2 and operably connected to the piston 42 for reciprocation in response to the piston 42; and (d) stationary production tube means 68, 70 inserted through the bore of the ram means 52 and connected to the hydraulic cylinder 2 for enabling well fluid 78 to be discharged from the well.

While this prior art mechanism has proven to be highly advantageous, it has been found that the positioning of the hydraulic fluid supply means 32, 38 around the circumference of the ram means 52 can result in a small ID production tube means 68, disadvantageous in some contexts. The present invention groups and radially offsets the hydraulic fluid supply means within the hydraulic cylinder, and the ram means are oppositely radially offset within the hydraulic cylinder, to address this problem.

Figure 2:
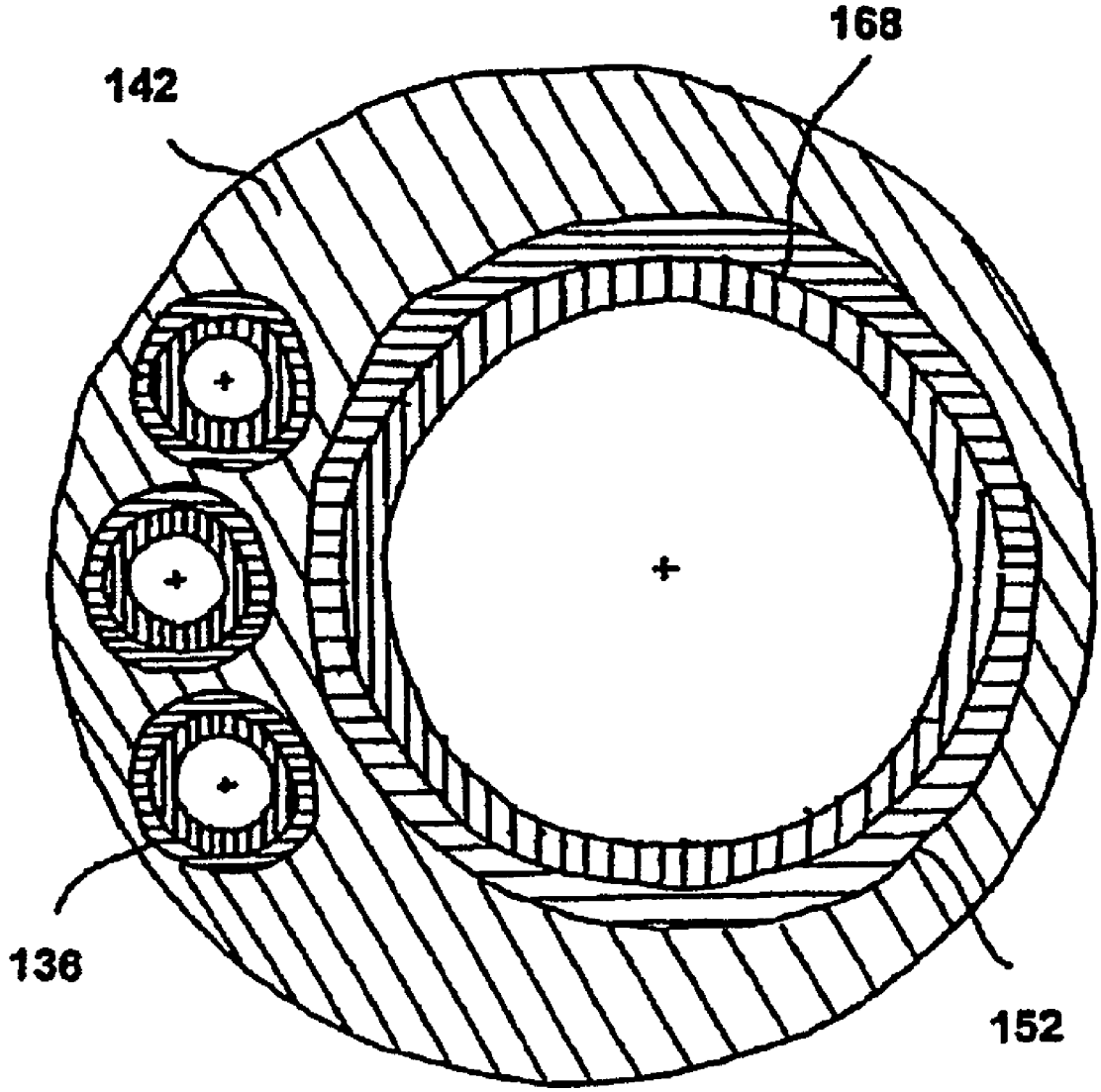
FIG. 2 is an enlarged cross-sectional plan view of an eccentric wellhead hydraulic drive unit according to the present invention along line 2-2 of FIG. 3, illustrating the grouping and offsetting of the hydraulic supply tubes and the offsetting of the ram and production tube.
Figure 3:
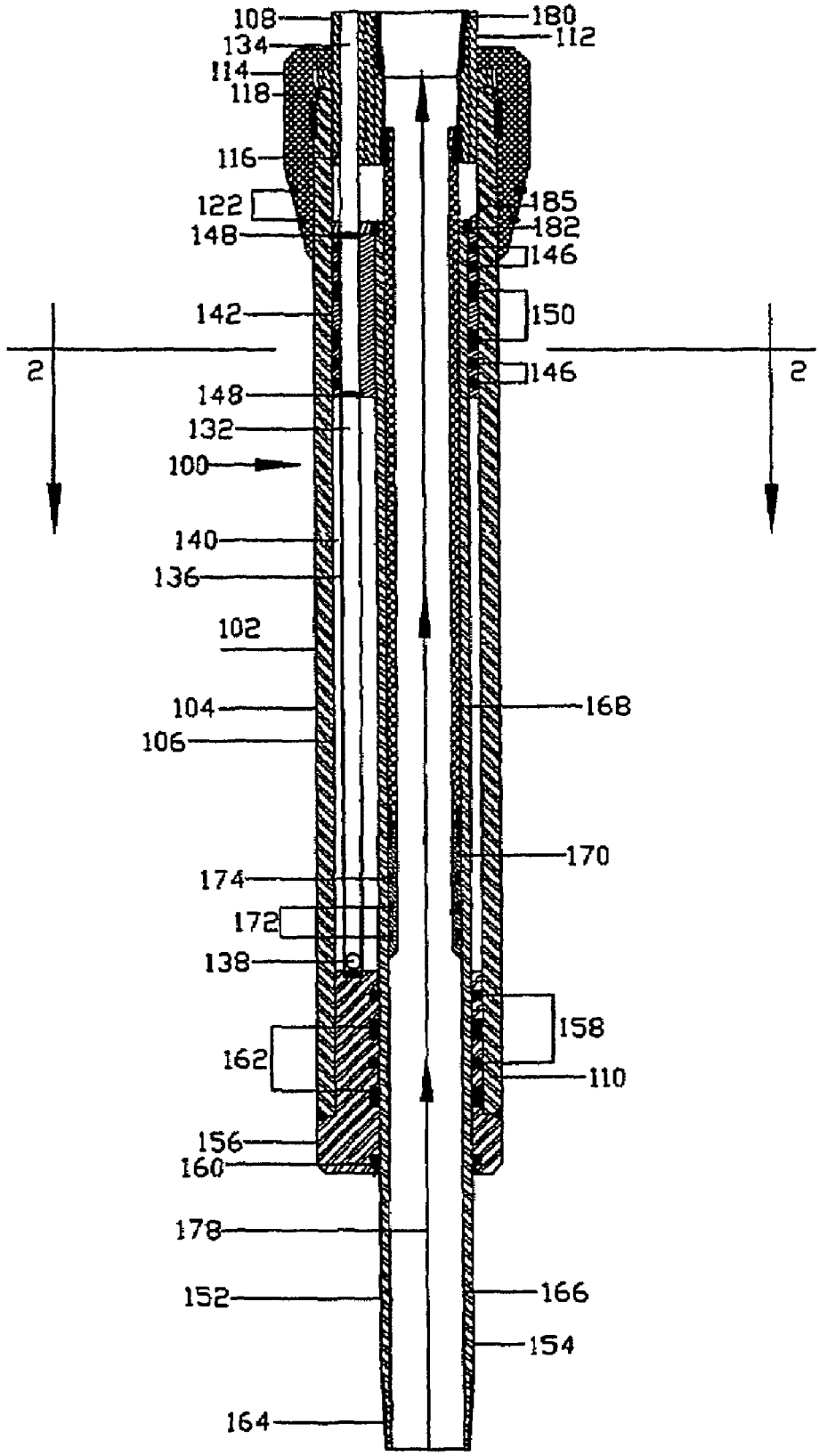
FIG. 3 is a cross-sectional elevation view of an eccentric wellhead hydraulic drive unit according to the present invention.

An eccentric wellhead hydraulic drive unit according to the present invention is illustrated in FIGS. 2 and 3.

With reference to FIG. 3, the eccentric wellhead hydraulic drive unit according to the present invention is shown designated generally by the reference numeral 100. The various parts which make up the drive unit 100 are for the most part housed within hydraulic cylinder 102. Hydraulic cylinder 102 is comprised of cylinder outer wall 104, cylinder inner wall 106, cylinder top end 108 and cylinder bottom end 110.

At cylinder top end 108 is situated top gland 112. Hanger 114 is threaded onto cylinder top end 108 of the hydraulic cylinder 102 to retain top gland 112 to hydraulic cylinder 102. Top gland seal 116 seals top gland 112 to cylinder inner wall 106 and hanger seal 118 seals hanger 114 to cylinder outer wall 104. Hanger 114 is sealed to the wellhead (not shown) by a plurality of wellhead seals 122.

It should be noted that hanger 114 profiles vary with different wellheads and are manufactured accordingly. Where applications restrict the use of hanger 114 in the wellhead itself, a landing spool (not shown) can be used. The landing spool is bolted on to the wellhead and the hanger 114 of the wellhead hydraulic drive unit 100 will then be landed within the landing spool.

The wellhead hydraulic drive unit 100 can also be directly bolted to the wellhead by means of a flange (not shown), where well control precautions are not an issue. The flange means would be directly threaded onto the wellhead hydraulic drive unit 100 and then bolted directly onto the wellhead.

The wellhead hydraulic drive unit 100 is operated by hydraulic power supplied from an outside source, capable of delivering and operating from 500 psi to 4,000 psi. Hydraulic fluid 132 is delivered to the wellhead hydraulic drive unit 100 via top gland 112. Hydraulic fluid enters in through hydraulic fluid port 134 and flows down through internal porting (not shown) in top gland 112. The hydraulic fluid 132 is then routed through the top gland porting down through a plurality of feed tubes 136 attached to top gland 112 and out feed tube ports 138 into lower annular area 140.

Hydraulic pressure in lower annular area 140 delivers force to main piston 142 for the upstroke or retraction movement. Down stroke movement or extension is normally achieved by tubing or rod weight from below (not shown). In applications where the tubing or rod weight is insufficient, hydraulic fluid can also be delivered to the top side of the main piston 142 through another hydraulic fluid port/vent (not shown in FIG. 3, but shown in a prior art mechanism in FIG. 1) to actuate downward force.

As stated above, the present invention groups and radially offsets the hydraulic fluid supply means within the hydraulic cylinder, and the ram means are oppositely radially offset within the hydraulic cylinder. As can be seen in FIG. 2, the feed tubes 136 of the hydraulic fluid supply means pass through the piston 142 and are grouped together (three in this embodiment, but a different number can be employed as required), and they are offset toward one side of the piston 142. The ram 152 (discussed below), and the production tube 168 housed within the bore of the ram 152 (also discussed below), is offset toward an opposite side of the piston 142. Offsetting the hydraulic fluid supply means and the ram allows for a larger inside diameter (ID) in both the production tubing and ram, increases the sizes of downhole pumps which can be installed/removed without removal of the drive unit, and serves as an anti-rotational feature with regards to the piston and ram.

For example, in a piston 42 according to the prior art drive unit of FIG. 1 having a 5.5 inch OD, distributing ¾inch feed tubes 36 around the circumference of the piston 42 would result in a maximum production tube 68 ID of approximately 2 inches. However, grouping and offsetting feed tubes 136 in accordance with the present invention, and correspondingly offsetting the ram 152 and production tube 168 in an opposite direction, results in a maximum production tube 168 ID of approximately 3 inches. As can clearly be seen, this provides a substantial advantage in contexts where a larger ID production tube is required or desired, increasing production tube ID by up to 50 percent. By increasing the maximum production tube ID, larger downhole pump assemblies can be installed or removed without requiring removal of the wellhead hydraulic drive unit 100. Also, oppositely offsetting the feed tubes 136 and the ram 152 assists in preventing rotation of the ram 152 and piston 142 within the hydraulic cylinder 102, a useful feature allowing for the manipulation of other downhole equipment (not shown) where rotation is required for operation.

Returning to FIG. 3, a plurality of piston seals 146 provides sealing between main piston 142 and cylinder inner wall 106. A plurality of feed tube seals 148 provides sealing between main piston 142 and feed tubes 136. Wear rings 150 help provide main piston 142 alignment to cylinder inner wall 106 of hydraulic cylinder 102.

Main piston 142 is threaded onto cylindrical ram 152 and has a non-rotational lock ring 182. This allows for the wellhead hydraulic drive unit 100 to provide torque to downhole tools where applicable. The torque is applied to hydraulic cylinder 102 and transmitted out to cylindrical ram 152 via main piston 142 and feed tubes 136. It is designed to deliver either right or left hand torque in the fully open or fully closed positions only.

Cylindrical ram 152 has ram outer wall 154 and ram inner wall 166. Cylindrical ram 152 moves up and down within hydraulic cylinder 102 relative to main piston 142. Cylindrical ram 152 extends the length of hydraulic cylinder 102 from main piston 142 through cylinder bottom end 110 of hydraulic cylinder 102. Cylindrical ram top 185 is threaded and is threadably received by the main piston 142.

Cylindrical ram bottom 164 is threaded to allow for connecting to a downhole pump via pump connecting means (not shown). Pump connecting means such as tubing joints, continuous tubing, sucker rods and continuous rods can either threadably receive threaded cylindrical ram bottom 164 or various crossover adapter designs can be used to couple the ram bottom 164 with pump connecting means. The design and type of pump will determine crossover design of the coupling adapter.

At cylinder bottom end 110, end gland 156 is welded in place to cylinder inner wall 106. A plurality of end gland seals 158 provides sealing between cylindrical ram 152 and end gland 156. Wiper 160 wipes cylindrical ram 152 clean to keep contaminants from entering end gland seals 158. Wear rings 162 help provide cylindrical ram 152 alignment inside end gland 156.

Housed within the bore of cylindrical ram 152 is production tube 168. Production tube 168 is threaded into top gland 112 to create a positive pressure seal. Attached to production tube 168 is production tube piston 170. A plurality of production tube seals 172 provides sealing between production tube piston 170 and ram inner wall 166. An additional production tube seal 174 also provides sealing between production tube piston 170 and cylindrical ram 152.

As production fluid 178 is pumped from the bottom of the well to surface, it enters into the inner diameter of cylindrical ram 152 as shown by the arrow. As production fluid enters into cylindrical ram 152, it is produced up through the wellhead hydraulic drive unit 100 by means of the production tube piston 170 and through production tube 168. Production fluid 178, after passing through production tube 168 then enters top gland 112 and exits out to the surface via a flow line (not shown) which is connected to top gland 112 by threading into top gland thread 180.

In practice, hydraulic fluid 132 is supplied at top gland 112 and fed through one or more feed tubes 136 having hydraulic fluid ports 134 at the bottom for hydraulic flow. This hydraulic fluid path provides for main piston 142 upstroke or hydraulic cylinder retraction. Hydraulic fluid can also be supplied directly through the top gland 112 to the top side of the main piston 142 via a second hydraulic fluid port/vent (not shown in FIG. 3, but shown in a prior art mechanism in FIG. 1), but for piston downstroke or hydraulic cylinder extension.

The up and down stroking movement actuates the downhole pump allowing for production fluid 178 to surface. The production fluid 178 passes up through the downhole production tubing, through the cylindrical ram 152, through the production tube piston 170 and production tube 168, and finally through the top gland 112 to exit at the surface via a vent or flow line (not shown) attached to the wellhead hydraulic drive unit 100.

Hydraulic pressure to the main piston 142 is supplied from a surface pump via a control line (not shown) connected to the cylinder top end 108 of the hydraulic cylinder 102. The power for the hydraulic pump can either be electric and/or internal combustion motor.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

Embodiments of the invention in which an exclusive property or privilege is claimed are defined as follows:

1. A wellhead hydraulic drive unit for operable connection to a downhole production pump via pump connecting means, the wellhead hydraulic drive unit comprising:

(a) a hydraulic cylinder having an inner wall and a piston positioned within the inner wall for reciprocation within the hydraulic cylinder;

(b) hydraulic fluid supply means contained within the hydraulic cylinder and fluidly communicative with the piston such that hydraulic fluid flowing through the hydraulic fluid supply means produces reciprocation of the piston within the hydraulic cylinder;

(c) ram means having a bore therethrough, slideably received within the inner wall of the hydraulic cylinder and operably connected to the piston for reciprocation in response to reciprocative movement of the piston; and (d) production tube means inserted through the bore of the ram means and connected to the hydraulic cylinder for enabling well fluid to be discharged from the well;

wherein a longitudinal axis of the hydraulic fluid supply means is radially offset from a longitudinal axis of the hydraulic cylinder, and a longitudinal axis of the ram means is oppositely radially offset from said longitudinal axis of the hydraulic cylinder.

2. The wellhead hydraulic drive unit of claim 1 wherein the piston comprises at least one passage extending axially therethrough, and the hydraulic fluid supply means comprise at least one hydraulic tube extending through the at least one passage.

3. The wellhead hydraulic drive unit of claim 2 wherein the at least one hydraulic tube is adapted to selectively pressurize an area upstream of the piston so as to cause the piston and the ram means to move in a downstream direction.

4. The wellhead hydraulic drive unit of claim 3 wherein the hydraulic fluid supply means further comprise at least one hydraulic passage means adapted to selectively pressurize an area downstream of the piston so as to cause the piston and the ram means to move in an upstream direction.

5. The wellhead hydraulic drive unit of claim 4 wherein the at least one hydraulic passage means comprise the at least one hydraulic tube at least partially within a gland downstream of the piston.

6. The wellhead hydraulic drive unit of claim 4 wherein the area downstream of the piston is annular.

7. The wellhead hydraulic drive unit of claim 3 wherein the area upstream of the piston is annular.

8. The wellhead hydraulic drive unit of claim 2 wherein the hydraulic fluid supply means further comprise a gland to which the at least one hydraulic tube is attached.

9. The wellhead hydraulic drive unit of claim 8 wherein the production tube means are threaded along at least a portion of their length and the gland of the hydraulic fluid supply means threadably receives the production tube means.

10. The wellhead hydraulic drive unit of claim 2 comprising a plurality of hydraulic tubes each extending through one of a plurality of passages in the piston.

11. The wellhead hydraulic drive unit of claim 10 wherein the plurality of hydraulic tubes are grouped together and radially offset toward one side of the hydraulic cylinder.

12. The wellhead hydraulic drive unit of claim 11 wherein the plurality of hydraulic tubes are generally parallel and spaced along the inner wall of the hydraulic cylinder at a generally equal distance from a central axis of the hydraulic cylinder.

13. The wellhead hydraulic drive unit of claim 1 wherein the production tube means are configured to receive the downhole production pump therethrough during installation of the downhole production pump.

14. The wellhead hydraulic drive unit of claim 1 further comprising means for mounting the wellhead hydraulic drive unit to a wellhead.

15. The wellhead hydraulic drive unit of claim 14 wherein the means for mounting the wellhead hydraulic drive unit to the wellhead comprise a hanger means attached to the hydraulic cylinder for landing the hydraulic cylinder within the wellhead.

16. The wellhead hydraulic drive unit of claim 1 wherein a top end of the ram means is threaded and the piston threadably receives the top end of the ram means.

17. The wellhead hydraulic drive unit of claim 1 wherein a bottom end of the ram means is threaded and the pump connecting means threadably receives the bottom end of the ram means.

18. The wellhead hydraulic drive unit of claim 1 wherein the pump connecting means are selected from the group consisting of tubing joints, continuous tubing, sucker rods and continuous rods.

19. An annular piston for use with a wellhead hydraulic drive unit, the wellhead hydraulic drive unit for operable connection to a downhole production pump via pump connecting means, the annular piston comprising:

(a) an outer wall for positioning within an inner wall of an hydraulic cylinder;

(b) a bore therethrough for receiving a ram means;

(c) passages extending axially through the piston; and (d) hydraulic fluid supply tubing contained within the passages and fluidly communicative with the piston such that hydraulic fluid flowing therethrough produces reciprocation of the piston within the hydraulic cylinder;

wherein a longitudinal axis of the hydraulic fluid supply tubing is radially offset from a longitudinal axis of the piston, and a longitudinal axis of the ram means is oppositely radially offset from said longitudinal axis of the piston.

* * * * *